US006143458A

United States Patent [19]

Berk

[11] Patent Number: 6,143,458

[45] Date of Patent: Nov. 7, 2000

[54] PHOTOCONDUCTIVE DRUM HANDLING APPARATUS

[75] Inventor: Nahit Berk, Venray, Netherlands

[73] Assignee: Xerox Corporation, Stamford, Conn.

[21] Appl. No.: 09/317,330

[22] Filed: May 24, 1999

[51] Int. Cl.[7] ..... B66C 1/46; G03G 5/00

[52] U.S. Cl. ..... 430/127; 294/98.1

[58] Field of Search ..... 294/98.1, 119.3; 430/127

[56] References Cited

U.S. PATENT DOCUMENTS

| | | | |
|---|---|---|---|
| 4,253,694 | 3/1981 | Walter et al. | 294/98.1 |
| 4,680,246 | 7/1987 | Aoki et al. | 430/133 |
| 4,783,108 | 11/1988 | Fukuyama et al. | 294/98.1 |
| 5,358,296 | 10/1994 | Kilmer et al. | 294/98.1 |
| 5,449,182 | 9/1995 | Petralia | 294/98.1 |

*Primary Examiner*—John Goodrow
*Attorney, Agent, or Firm*—H. Fleischer

[57] ABSTRACT

An apparatus for handling a tubular member uses a hollow member having a closed end. A portion of the hollow member is inflatable. The hollow member is mounted on a device which moves the hollow member from a position remote from the tubular member to a position in which the hollow member is inserted in the tubular member. The hollow member extends in the tubular member a distance less than one-half the length of the tubular member. A source of fluid is coupled to the hollow member to supply fluid to the hollow member for inflating the inflatable portion thereof. This secures the hollow member to the tubular member so that the hollow member and the tubular member move substantially in unison with one another.

7 Claims, 3 Drawing Sheets

PHOTOCONDUCTIVE DRUM HANDLING APPARATUS

This invention relates generally to an apparatus for handling and a method of making a photoconductive drum, and more particularly concerns the apparatus and method of holding the substrate during the coating of the drum.

A typical electrophotographic printing machine employs a photoconductive member. The photoconductive member may be a belt or a drum. This photoconductive member is charged with substantial uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. The developed image is transferred to a sheet and subsequently permanently fused thereto by the application of heat thereon. In order to be able to produce high quality prints, it is necessary to produce high quality photoconductive members. Photoconductive members generally include a substrate having a photoconductive material coated thereon. It is highly important to ensure that the coating of photoconductive material on the substrate is uniform. Non-uniformities in this coating will result in degradation in print quality. Thus, the manufacturing of the photoconductive member is critical to the successful production of high quality prints from an electrophotographic printing machine.

Many photoconductive members are made from drums. These photoconductive drums are manufactured by dipping a hollow drum into a series of liquids, e.g., a protecting liquid, a blocking layer liquid, and conductive liquids. Heretofore, the photoconductive layer was coated on the drum substrate by immersing the drum in a solution of photoconductive material. The drum is held by an inflatable member which is tightly pressed against the interior circumferential walls thereof. After this mechanism secures the drum thereto, the drum is raised and vertically lowered into a liquid. In this way, there is no contact with the exterior circumferential surface of the drum and, ideally, the coating of liquid will be substantially uniform. The holding mechanism heretofore utilized extends into the drum a distance greater than one-half the length of the drum. As the drum is immersed in the liquid, the vapor pressure inside the drum increases. As the drum is withdrawn from the liquid, the vapor escapes from the interior of the drum and passes through the liquid resulting in vibration of the liquid in the coating tank. The vibration of the liquid during the coating process results in thickness non-uniformities occurring in the coating. Thus, it is highly desirable to eliminate coating defects produced by the escaping vapors.

Various types of holding techniques have been devised for securing photoconductive drums during the immersion of the substrate into the liquid. The following disclosures appear to be relevant:

U.S. Pat. No. 4,680,246

Patentee: Aoki, et al.

Issued: Jul. 14, 1987

U.S. Pat. No. 4,783,108

Patentee: Fukuyama, et al.

Issued: Nov. 8, 1988

U.S. Pat. No. 4,680,246 discloses a method for holding a hollow, cylindrical body which is being immersed into a liquid so as to be coated with the liquid. The device includes an inflatable elastic membrane which tightly contacts the inside wall of the cylindrical body so as to hold the body when it is inflated. The hollow cylindrical body is immersed into a liquid to form a coating on the exterior circumferential surface thereof.

U.S. Pat. No. 4,783,108 discloses a catching head. The catching head has a tube expandable by air which contacts the interior circumferential surface of a hollow member.

In accordance with one aspect of the features of the present invention, there is provided an apparatus for handling a tubular member. The apparatus includes a hollow member having a closed end with a portion thereof being inflatable. A device having the hollow member mounted thereon is movable. The device moves the hollow member from a position remote from the tubular member to a position in which the hollow member is inserted in the tubular member. The hollow member extends in the tubular member a distance less than one-half the length of the tubular member. A source of fluid is coupled to the hollow member to supply fluid to the hollow member for inflating the inflatable portion thereof. The inflatable portion secures the hollow member to the tubular member so that the hollow member and the tubular member move substantially in unison with one another.

Pursuant to another aspect of the present invention, there is provided a method of making a photoconductive member. This includes inserting a hollow member having a closed end with a portion thereof being inflatable into a tubular member. The hollow member is positioned at a location such that the hollow member extends in the tubular member a distance less than one-half the length of the tubular member. Fluid is supplied to the hollow member to inflate the inflatable portion thereof. This secures the hollow member to the tubular member so that the hollow member and the tubular member move substantially in unison with one another.

Other aspects of the present invention will become apparent as the following description proceeds and upon reference to the drawing, in which.

Figure 1:
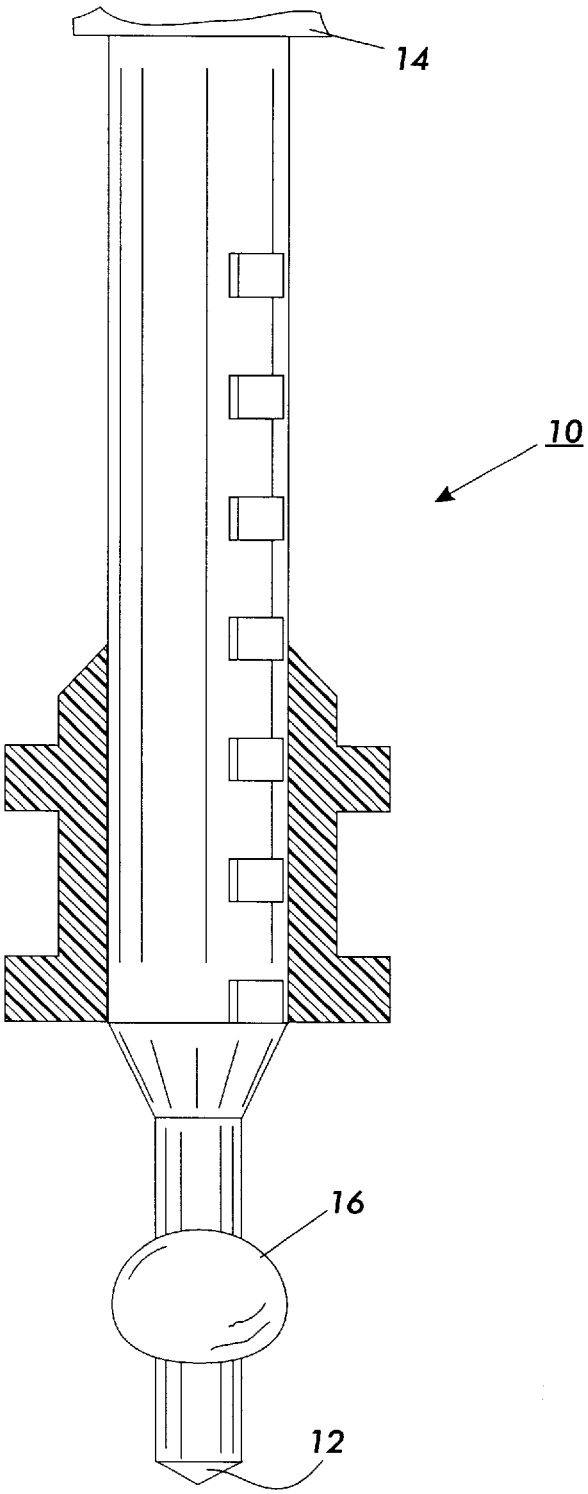
FIG. 1 is a schematic elevational view, partially in section, showing the member adapted to grip the tubular member being immersed in the liquid.

While the present invention will hereinafter be described in connection with a preferred embodiment and method of use thereof, it will be understood that it is not intended to limit the invention to that embodiment or method of use. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used throughout to designate identical elements.

Referring initially to FIG. 1, there is shown a hollow member, or chuck, indicated generally by the reference numeral 10, for supporting a tubular member or photoconductive drum substrate. Chuck 10 is hollow and has end 2 thereof closed. End 14 is connected to a source of fluid, i.e., compressed air. Chuck 10 includes an inflatable portion indicated by the reference numeral 16. Inflatable portion 16 is preferably a flexible bellows made from rubber. The closed end of chuck 10 is preferably conical in shape. In operation, chuck 10 is inserted into the interior of the tubular member or drum substrate. After being so inserted into the drum substrate, compressed air is furnished to chuck 10 inflating rubber bellows 16. Rubber bellows 16 engages the interior circumferential surface of the drum substrate. Thereafter, the drum substrate and chuck 10 area moved in unison. The drum is then immersed into a tank containing a liquid which is coated on the exterior circumferential surface thereof. The foregoing will be explained in more detail with reference to FIGS. 2 and 3.

Figure 2:
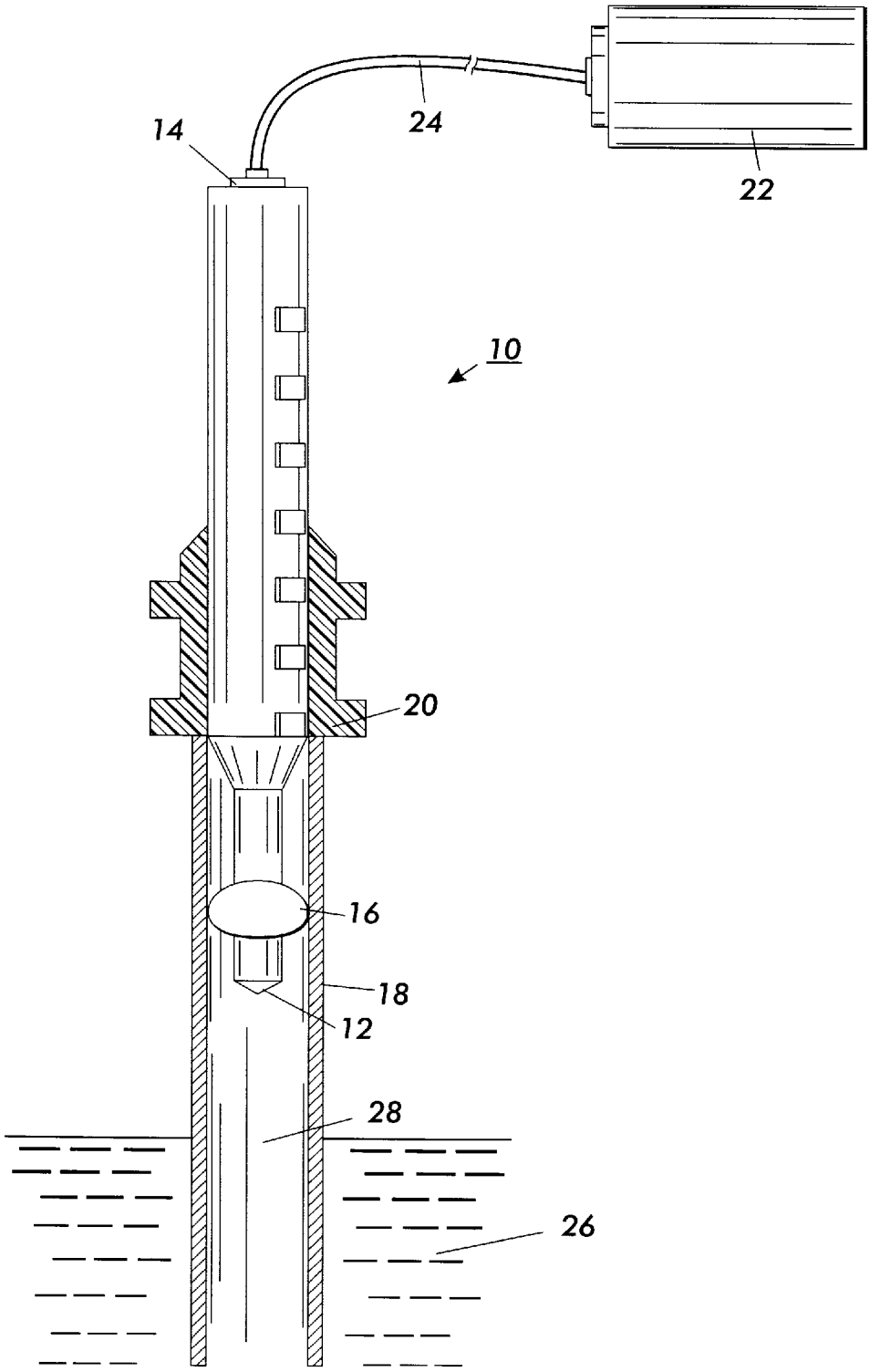
FIG. 2 is an elevational view, partially in section, showing the tubular member supported by the hollow member being immersed in the liquid.

Turning now to FIG. 2, there is shown chuck 10 inserted into aluminum substrate 18. Aluminum substrate 18 is an open ended tube which functions as the substrate for the photoconductive drum. A series of materials are coated on the exterior circumferential surface of aluminum drum 18 to form the photoconductive drum. Chuck 10 is inserted into drum 18 until flanges 20 engage one end of drum 18. At this location, bellows 16 extends a distance less than one-half the overall length of drum 18. Thus, when bellows 16 is inflated and engages the interior circumferential surface of drum 18, it forms a seal in the upper half of drum 18. Pump 22 is connected to end 14 of chuck 10 by conduit or tubing 24. Energization of pump 22 forces compressed air into chuck 10. The compressed air inflates bellows 16 to secure chuck 10 to drum 18. Thereafter, chuck 10 and drum 18 move in unison with one another so as to immerse drum 18 in liquid 26. Liquid 26 may be the protecting liquid, the blocking layer liquid, or the conductive liquids. One skilled in the art will appreciate that the liquid may be any or all of the liquids required to produce a photoconductive coating on the drum. Some liquids 26 are required to be maintained at a relatively low temperature with the ambient temperature being maintained at a relatively high temperature. However, other liquids do not require this temperature difference. Thus, the environment surrounding liquid 26 is maintained at a higher temperature than that of liquid 26. This further promotes the elimination of any defects and ensures the uniformity of coating. Vapors and air are trapped in chamber 28 of drum 18 as drum 18 is immersed in liquid 26. However, inasmuch as chamber 28 is much larger than has heretofore been utilized, this results in a lower pressure in chamber 28. As was previously mentioned, chuck 10 extended into drum 18 a distance more than half the length thereof. This resulted in a significantly smaller chamber in the prior art devices than is presently achieved in the present invention. Inasmuch as the chamber was significantly smaller, there was a greater build-up of pressure in chamber 18. It has been found that the escaping vapor and air, when under a significantly lower pressure, do not produce vibrations in the liquid 28 as they escape during the coating cycle. Thus, there is a significant improvement in the uniformity of the coating on the exterior circumferential surface of drum 18.

Figure 3:
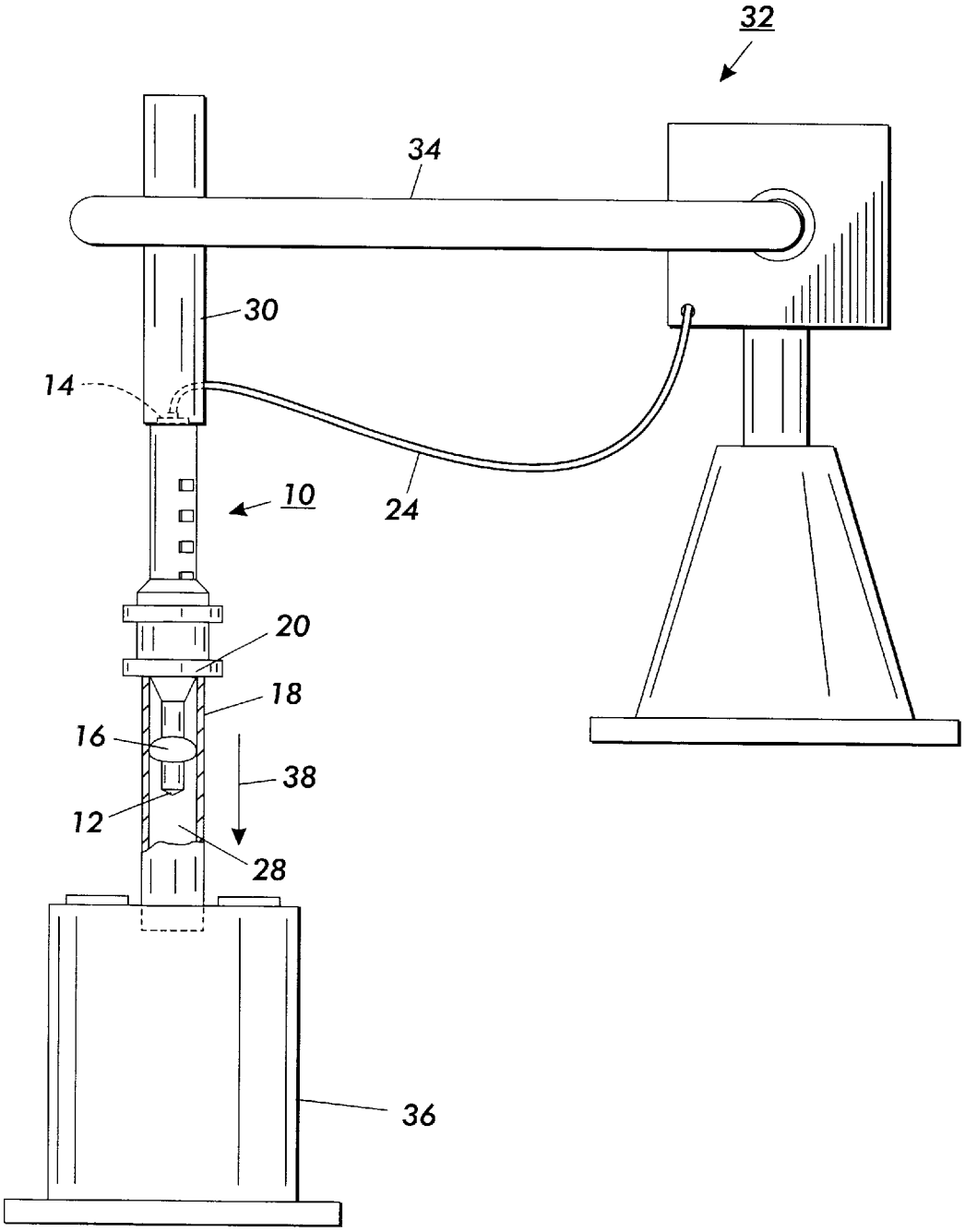
FIG. 3 shows a robotic assembly for moving the tubular members gripped by the hollow member to the tank storing a supply of liquid for the coating process.

Turning now to FIG. 3, there is shown chuck 10 mounted in arm 30 of robotic assembly 32. Arm 30, in turn, is mounted in arm 34. Initially, robot assembly 32 moves chuck 10 from a non-operative or remote position to a position in which chuck 10 is inserted into drum 18 such that flange 20 engages one end of drum 18. Chuck 10 extends a distance less than one-half the length of drum 18 when inserted in drum 18. After being properly located in drum 18, flexible bellows 16 is inflated and grips the interior circumferential surface of drum 18. Thereafter, drum 18 and chuck 10 are moved in unison with one another by robot assembly 32. Robot assembly 32 positions drum 18 over tank 36. When drum 18 is properly positioned, robot assembly 32 moves drum 18 in a downwardly direction, i.e., as indicated by arrow 38, so as to immerse drum 18 in the liquid of tank 36. The liquid in tank 36 is maintained at a lower temperature than the ambient temperature surrounding tank 36. Tank 36 and the immediate environs thereof are mounted in a chamber or booth. It is the chamber temperature that is maintained relatively high with respect to the temperature of the liquid. As shown in FIGS. 2 and 3, drum 18 is vertically oriented, and is moved in a substantially vertical direction to initially immerse it into the liquid and, subsequently, to withdraw it from the liquid. Where the chamber size is maximized, the increase in vapor pressure inside the chamber is minimized as drum 18 is immersed in the liquid, disturbances of the liquid are minimized and the coating uniformity optimized.

In recapitulation, it is clear that the present invention is directed to a vertically oriented drum which has a holding device inserted therein and a portion thereof inflated to secure the holding device to the drum substrate. The drum substrate is then immersed in a liquid and withdrawn therefrom to coat the exterior circumferential surface thereof with the liquid. The holding device and the inflatable portion thereof are inserted into the drum substrate a distance less than one-half the length of the drum substrate so as to reduce the interior vapor and air pressure therein as the drum is being immersed and withdrawn from the liquid. This reduces the disturbances of the liquid during the coating cycle and improves the uniformity of the coating layer. Further improvement is also achieved for some liquid, by maintaining the temperature of the liquid less than that of the surrounding environment during the coating process.

It is therefore apparent that there has been provided in accordance with the present invention an apparatus and method for handling and manufacturing a photoconductive member which fully satisfies the aims and advantages hereinbefore set forth. While this invention has been described in conjunction with a specific embodiment and method of use thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for handling a tubular member, including;

a hollow member having a closed end with a portion thereof being inflatable;

a device having said hollow member mounted thereon, said device being movable to move said hollow member from a position remote from said tubular member to a position in which said hollow member is inserted in said tubular member with said hollow member extending in the tubular member a distance less than one half the length thereof;

a source of fluid coupled to said hollow member to supply fluid to said hollow member for inflating said inflatable portion to secure said hollow member to the tubular member so that said hollow member and the tubular member move substantially in unison with one another;

a tank having a supply of liquid therein, said device being adapted to immerse the tubular member in the liquid after said hollow member is secured thereto; and a chamber having said tank located therein with the temperature of said chamber being maintained higher than the temperature of the liquid in said tank.

2. An apparatus according to claim 1, wherein the inflatable portion of said hollow member includes a flexible bellows.

3. An apparatus according to claim 2, wherein the closed end of said hollow member includes a conical portion.

4. An apparatus according to claim 2, wherein said bellows includes a portion made from a rubber material.

5. An apparatus according to claim 1, wherein the fluid supplied from said fluid source includes air.

6. An apparatus according to claim 1, wherein said device includes a robotic assembly.

7. An apparatus according to claim 1, wherein the tubular member includes a substrate for a photoconductive member.

* * * * *